US005921179A

United States Patent [19]

Gäng et al.

[11] Patent Number: 5,921,179

[45] Date of Patent: Jul. 13, 1999

[54] GUARD ON CONTRAROTATABLE CYLINDERS OF A PRINTING PRESS

[75] Inventors: Manfred Gäng, Oberhausen/Rheinhausen; Erich Michael Zahn, Eppelheim, both of Germany

[73] Assignee: Heidelberger Druckmaschinen AG, Heidelberg, Germany

[21] Appl. No.: 09/022,653

[22] Filed: Feb. 12, 1998

[30] Foreign Application Priority Data

Feb. 12, 1997 [DE] Germany ..... 197 05 218

[51] Int. Cl.[6] ..... B41F 5/00

[52] U.S. Cl. ..... 101/216; 101/218

[58] Field of Search ..... 101/216, 218; 307/326

[56] References Cited

U.S. PATENT DOCUMENTS

| | | | |
|---|---|---|---|
| 3,256,395 | 6/1966 | GRau et al. | 200/52 R |
| 3,498,217 | 3/1970 | Kletti | 101/216 |
| 4,454,812 | 6/1984 | Johne et al. | 101/216 X |
| 4,669,380 | 6/1987 | Seib et al. | 101/216 |
| 5,024,155 | 6/1991 | Jahn | 101/216 |
| 5,025,677 | 6/1991 | Muller et al. | 74/473.29 |

FOREIGN PATENT DOCUMENTS

| | | |
|---|---|---|
| 1050132 | 2/1959 | Germany . |
| 1165044 | 4/1965 | Germany . |
| 3613463A1 | 11/1987 | Germany . |
| 407173 | 8/1966 | Switzerland . |

*Primary Examiner*—Edgar Burr
*Assistant Examiner*—Minh H. Chau
*Attorney, Agent, or Firm*—Herbert L. Lerner; Laurence A. Greenberg

[57] ABSTRACT

A guard for contrarotatable cylinders of a printing press includes a finger protective element disposable adjacent cylindrical surfaces of the cylinder for guarding a nip between the cylinders in vicinity of a danger zone, the finger protective element being in fixed position and having at least one switch sensor disposed in the region of the cylinder nip.

10 Claims, 3 Drawing Sheets

GUARD ON CONTRAROTATABLE CYLINDERS OF A PRINTING PRESS

BACKGROUND OF THE INVENTION

Field of the Invention

The invention relates to a guard on contrarotatable cylinders of a printing press, the guard having a finger-protective element disposed near cylindrical surfaces of the cylinders for guarding the nip between the cylinders in the region of the danger zone.

It has been known heretofore to provide finger-protective or guard elements on printing presses, which are respectively disposed forward or upstream of the nip between pairs of contrarotatable cylinders, as viewed in the direction of rotation thereof.

U.S. Pat. No. 5,024,155, which is assigned to the same corporate assignee as that of the instant application, for example, shows a finger protective element supported so as to be pivotable about a shaft and, upon the occurrence of a deflecting movement about this shaft, actuating a switch which shuts the printing press down.

In the device disclosed in the aforementioned U.S. patent, it is necessary to provide holders for the shaft of the finger protective element which permit pivoting motion. Indirect switching of mechanically actuatable switches provided in the device reduces the requisite functional safety.

SUMMARY OF THE INVENTION

It is accordingly an object of the invention to provide a guard for a nip between two contrarotatable cylinders which is of relatively simple construction and functionally safe.

With the foregoing and other objects in view, there is provided, in accordance with the invention, a guard device for contrarotatable cylinders of a printing press, comprising a finger protective element disposable adjacent cylindrical surfaces of the cylinders for guarding a nip between the cylinders in vicinity of a danger zone, the finger protective element being in fixed position and having at least one switch sensor disposed in the region of the cylinder nip.

In accordance with another feature of the invention, the finger protective element has a carrier body and a flexible profile body disposed thereon.

In accordance with a further feature of the invention, the carrier body and the profile body are mutually joined, either form-lockingly or force-lockingly. In this regard, it is noted that a form-locking connection is effected by the shapes of two mutually locking elements whereas a force-locking connection is effected by a force external to two locking elements.

In accordance with an added feature of the invention, the switch sensor is disposed in the flexible profile body.

In accordance with an additional feature of the invention, the switch sensor is located between the carrier body and the flexible profile body.

In accordance with yet another feature of the invention, the switch sensor is formed as one of a switch strip, switch mat, switch plate and switch foil.

In accordance with yet a further feature of the invention, the flexible profile body has two profile lips disposed so as to face towards the cylindrical surfaces.

In accordance with yet an added feature of the invention, the switch sensor is disposed within each of the profile lips.

In accordance with yet an additional feature of the invention, the switch sensor has a length equivalent at least to the length of the cylinder nip.

In accordance with still another feature of the invention, the guard device includes an electrical switch device operating in a "single-error safe" mode after-connected to the switch sensor.

In accordance with still a further feature of the invention, the switch device has two parallel switching paths, respectively, comprising a series circuit of a comparator and a logic module, the respective comparators of the series circuits being connected to one another by a connecting line.

In accordance with a concomitant feature of the invention, the guard device includes a relay having a relay contact and two outputs after-connected to each logic module.

A particular advantage of the invention is that the finger protective or guard element can be fixed in position, thereby providing the possibility of dispensing with movable bearing points.

The disposition of a switch element in the vicinity of the cylinder nip which is to be protected permits rapid, direct and immediate switching in order to stop the machine and the contrarotating cylinders, respectively.

Another advantage is that the finger protective element can be disposed very closely to the cylindrical surfaces of the cylinders, i.e., less than 6 mm away from them. Then, also an unintentionally detached end of the rubber blanket can actuate the switch device.

In an advantageous construction of the device according to the invention, the finger protective element is a fixedly disposed crossbar or traverse carrying an elastic profile with one or more line jacks mounted thereon. Due to this provision, the profile of the finger protective element can be adapted, by variable shaping, to the requirements of the installation space.

The nature of the material forming the profile advantageously determines the tripping force for shutting down the printing press. In another advantageous construction, an electrical switch arrangement operating in the so-called "single-error safe" mode is connected to the line jack.

Other features which are considered as characteristic for the invention are set forth in the appended claims.

Although the invention is illustrated and described herein as embodied in a guard on contrarotating cylinders of a printing press, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, wherein:

DESCRIPTION OF THE PREFERRED EMBODIMENTS

Figure 1:
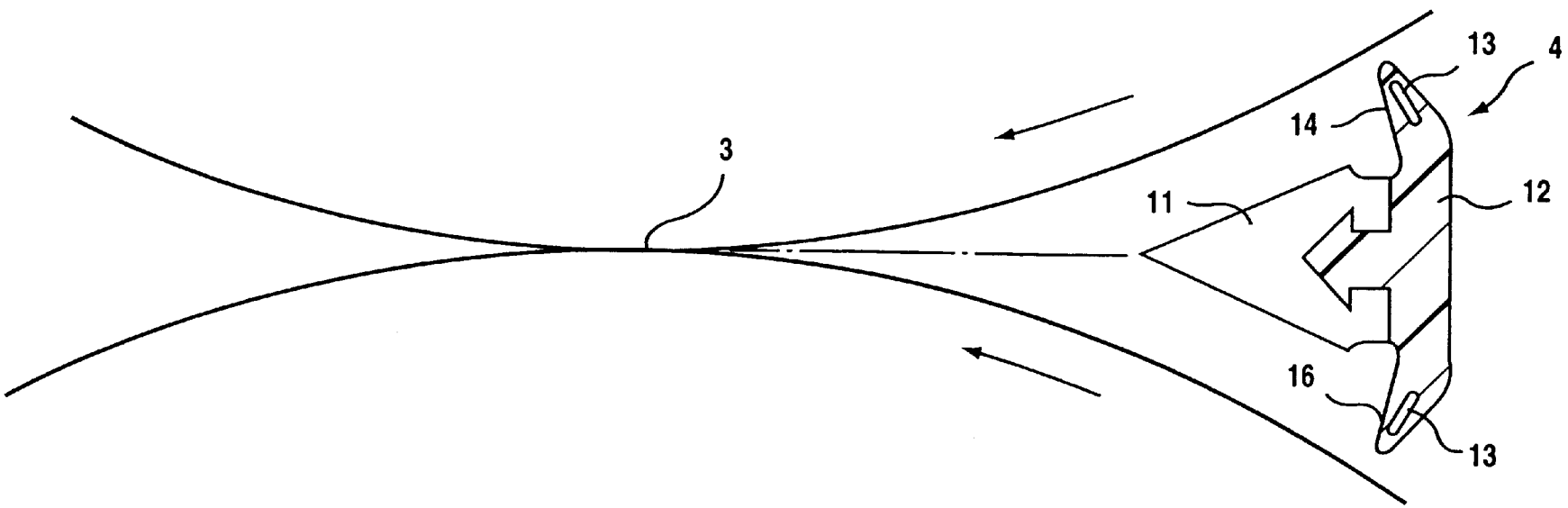
FIG. 1 is a diagrammatic view of contrarotatable cylinders having a nip therebetween within which a finger guard shown in cross section is disposed.

Referring now to the drawings and, first, particularly with regard to FIG. 1 thereof, there is shown therein a plate cylinder 1 and a rubber blanket cylinder 2 cooperating therewith in a printing press, the cylinders 1 and 2 having a nip therebetween in front of which a finger guard 4 according to the invention is disposed. The finger guard 4 may also be disposed in the immediate vicinity of an infeed region into a cylinder nip 3 for a paper sheet or a paper web, for example, between a rubber blanket cylinder and an impression cylinder.

The finger guard 4 is formed with a length, i.e., the dimension thereof extending perpendicularly to the plane of the drawing in FIG. 1, which is at least great enough to extend over the entire cylinder nip 3, i.e., again as viewed perpendicularly to the plane of the drawing in FIG. 1. As shown diagrammatically in FIG. 2, the ends 6 and 7 of the finger guard 4 are screwed firmly to the insides of respective side walls 8 and 9 of the printing press.

The finger guard 4 is essentially made up of a carrier body 11 selectively formed of steel, plastic material, aluminum, and so forth. Disposed on the carrier body 11 is an elastic profile 12 having a length corresponding to at least the length of the cylinder nip into which so-called "line jacks 13" are introduced. The elastic profile 12 is preferably joined in a form-locking manner to the carrier body 11. In this regard, it is again noted that a form-locking connection is one which results from the shapes of two connecting elements themselves as opposed to a force-locking connection wherein two elements are connected together by force external to the elements. A connection may also be made by adhesive bonding or by electroplating. A screwed or riveted connection is equally possible.

The line jacks 13 react sensitively to deformation or pressure, especially to pressure acting perpendicularly to the plane of the line jacks 13 which, when suitably loaded, emit an electrical signal to the drive control of the printing press. Such a signal results in an immediate arresting of the rotating cylinders 1 and 2, so as to provide assurance that foreign bodies, such as fingers, loose ends of a rubber blanket, cleaning equipment, and so forth, cannot be pulled into the cylinder nip 3.

Figure 5:
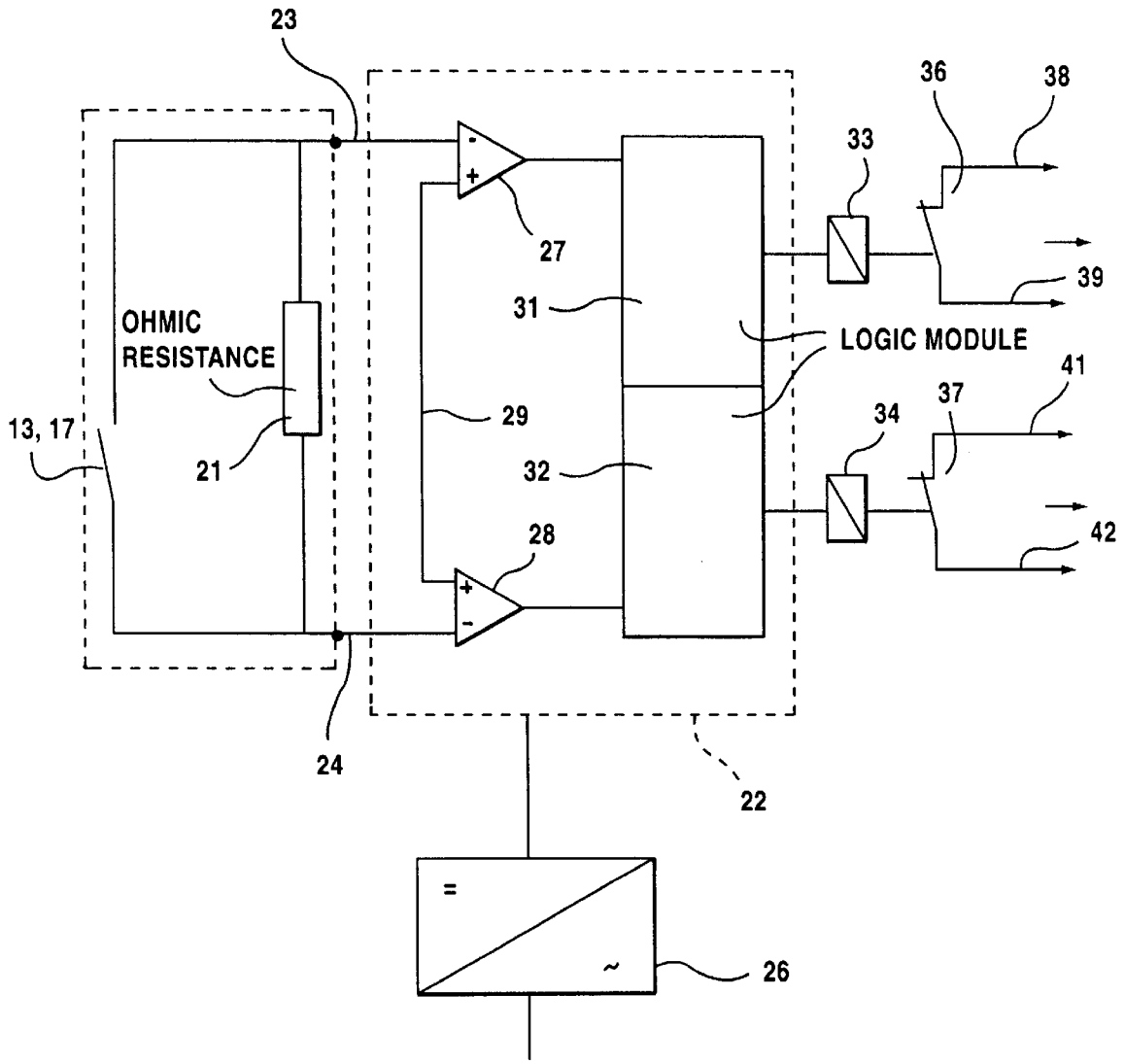
FIG. 5 is a schematic circuit diagram for a "single-error safe" circuit employed with the finger guard.

As shown in the circuit diagram of FIG. 5, an electrical switch arrangement is disposed between the line jack 13, 17 and the control computer of the printing press and assures the so-called "single-error safe" shutdown of the printing press. An ohmic resistance 21 is connected in parallel with the line jack 13, 17. A "single-error safe" switch module 22 is provided having two inputs 23 and 24 coming from the line jack 13, 17. An AC-DC source 26 supplies the switch module 22 with the required electrical voltage. The switch module 22 has two parallel-connected comparators 27 and 28 which are connected to one another by a connecting line 29. Each comparator 27, 28 is followed by a respective logic module 31, 32. Each logic module 31, 32 is followed by a respective relay 33, 34 having a respective relay contact 36, 37. Thus, for each relay contact 36, 37 which is provided, there are two outputs 38 and 39, on the one hand, and 41 and 42, on the other hand, which lead to the control computer or an "emergency cutoff" relay of the printing press.

The function of the "single-error safety" switch device is that when there is a failure, for example, of one of the logic modules 31 and 32, the device continues to operate safely via the parallel circuit of the respective other one of the logic modules 32 and 31, respectively, and shuts down the press.

Figure 2:
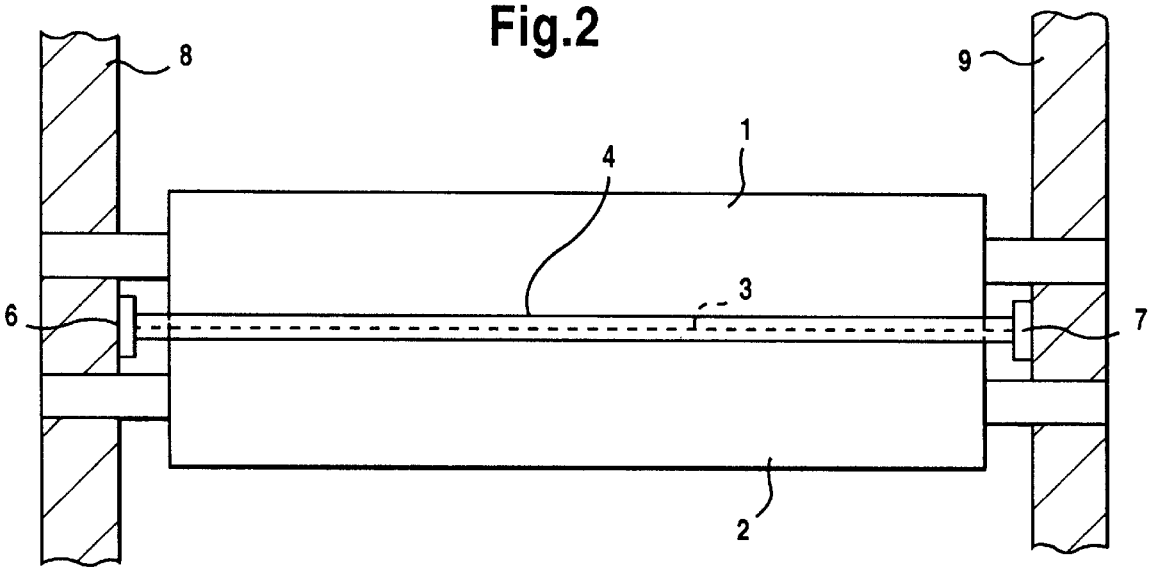
FIG. 2 is a greatly reduced right-hand side elevational view of FIG. 1 showing the guard according to the invention secured to side walls of a printing press provided with the contrarotatable cylinders.

In the embodiment of FIGS. 1 and 2, there are two line jacks 13, each one thereof extending over at least the entire length of the cylinder nip 3. Both of the line jacks 13 are disposed parallel to one another within respective profile lips 14 and 16, as shown in the embodiment of FIG. 1. The profile lips 14 and 16 are a component of the elastic profile 12, each of the profile lips 14 and 16, respectively, extending close (for example, 3 mm) to the surfaces of the cylinders 1 and 2. Because the profile lips 14 and 16 are not joined directly to the rigid carrier body 11, they are especially elastic and are therefore able to transmit external force factors or effects to the line jacks 13 and 17 in the form of switching pulses. Consequently, even relatively slight force factors or effects, such as the impact of a loose end of a rubber blanket, can lead to the actuation of one or both of the line jacks 13 and 17.

As required, the rigid carrier profile 11 can have various cross-sectional shapes, such as round, annular or toroidal, polygonal, and so forth. This is also true for the elastic profile 12 which carries the line jack or jacks 13 and 17.

Besides determining the shaping capabilities, the nature of the material of the profile 12 greatly determines the elasticity and consequently the sensitivity of the finger guard 4.

It is also possible to use a different number or types of line jacks 13 and 17. Besides providing the line jacks 13 and 17 in the form of switch strips, line jacks formed as switch sheets, switch mats, switch plates, and so forth, are also conceivable.

Figure 3:
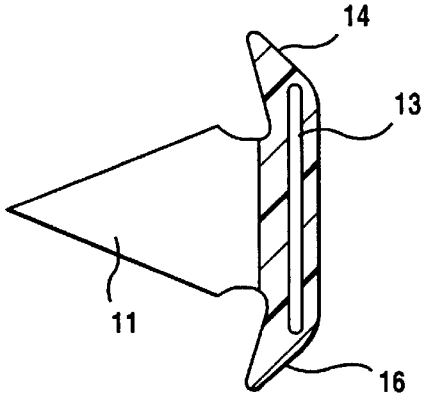
FIG. 3 is a cross-sectional view of another exemplary embodiment of the finger guard shown in FIG. 1.

In a second exemplary embodiment, it is contemplated that only a single line jack 13 corresponding to the length of the cylinder nip 3, i.e., this dimension thereof extending perpendicularly to the plane of the drawing in FIG. 3, be provided. This line jack 13 of FIG. 3 is disposed in the middle region of the profile 12 and has lateral edges which extend so close to the respective profile lips 14 and 16 that the lines of force action resulting from deformation in the body of the profile 12 can trip an actuation of the line jack 13.

Figure 4:
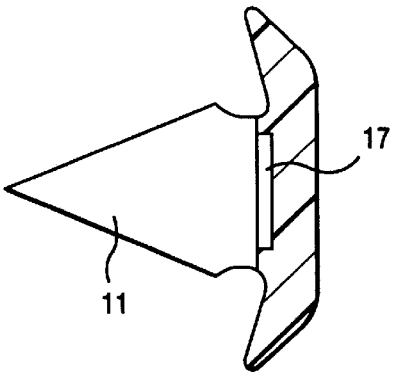
FIG. 4 is a cross-sectional view of a further exemplary embodiment of the finger guard.

In a third exemplary embodiment shown in FIG. 4, a line jack 17 is disposed for special applications between the carrier body 11 and the profile body 12. Because of this provision, the line jack 17 reacts especially to pressure loads in the region of the carrier body 11.

We claim:

1. A guard for contrarotatable cylinders of a printing press, comprising:

a finger protective element disposable adjacent cylindrical surfaces of the cylinders for guarding a nip between the cylinders in vicinity of a danger zone, said finger protective element being in fixed position and having at least one switch sensor disposed in a region of the cylinder nip, said finger protective element also having a carrier body and a flexible profile body disposed on said carrier body, said flexible profile body having two profile lips disposed so as to face towards the cylindrical surfaces.

2. The guard according to claim 1, wherein said carrier body and said flexible profile body are mutually joined.

3. The guard according to claim 1, wherein said switch sensor is disposed in said flexible profile body.

4. The guard according to claim 3, wherein said switch sensor is selected from the group consisting of a switch strip, switch mat, switch plate and switch foil.

5. The guard according to claim 1, wherein said switch sensor is located between said carrier body and said flexible profile body.

6. The guard according to claim 1, wherein said switch sensor is disposed inside each of said profile lips.

7. The guard according to claim 1, wherein said switch sensor has a length equivalent at least to the length of the cylinder nip.

8. The guard according to claim 1, including an electrical switch device actuating upon detection of a single error after being connected to said switch sensor.

9. The guard according to claim 8, wherein said electrical switch device has two parallel switching paths, respectively, comprising a series circuit of a comparator and a logic module, the respective comparators of the series circuits being connected to one another by a connecting line.

10. The guard according to claim 9, including a relay having a relay contact and two outputs after-connected to each logic module.

* * * * *